US005182954A

United States Patent [19]

Menheere

[11] Patent Number: 5,182,954

[45] Date of Patent: Feb. 2, 1993

[54] INNER TUBE ELEMENT FOR USE IN A DEVICE FOR TAKING SOIL SAMPLES, AND METHOD FOR MANUFACTURING SUCH AN INNER TUBE ELEMENT

[75] Inventor: Johannes C. J. Menheere, Dalfsen, Netherlands

[73] Assignee: Wavin B.V., Netherlands

[21] Appl. No.: 699,313

[22] Filed: Apr. 12, 1991

[30] Foreign Application Priority Data

Apr. 27, 1990 [NL] Netherlands ..... 9001025

[51] Int. Cl.[5] ..... E21B 49/02

[52] U.S. Cl. ..... 73/864.45; 138/104

[58] Field of Search ..... 73/864.45, 153; 175/44, 175/236, 239, 293; 138/104

[56] References Cited

U.S. PATENT DOCUMENTS

| | | | |
|---|---|---|---|
| 3,092,192 | 6/1963 | Deely | 175/239 X |
| 3,343,568 | 9/1967 | Branscum et al. | 138/104 UX |
| 3,450,216 | 4/1969 | Hugel et al. | 175/44 |
| 4,428,602 | 1/1984 | Lambot et al. | 175/236 X |
| 4,911,001 | 3/1990 | Ferguson | 73/153 |

FOREIGN PATENT DOCUMENTS

| | | |
|---|---|---|
| 0056930 | 11/1982 | European Pat. Off. . |
| 0253473 | 3/1988 | European Pat. Off. . |
| 2914977 | 10/1980 | Fed. Rep. of Germany . |
| 330051 | 9/1929 | United Kingdom . |

OTHER PUBLICATIONS

Oil & Gas Journal, vol. 82, No. 51, Dec. 1984, pp. 118–120, "How to Recover, Label, and Evaluate Fractured Core", by J. T. Kirkland, Tulsa, Okla.

*Primary Examiner*—Jerry W. Myracle
*Attorney, Agent, or Firm*—Wigman & Cohen

[57] ABSTRACT

Described is an inner tube element for use in a double tube device for taking soil samples during drilling operation (coring), the inner tube element comprising distinguishable end parts which are connected by a tube member of fiber reinforced plastic. According to the invention such tube member is provided with an orientation marking over its whole length and at least covered by a thin layer of plastic. An attractive embodiment of such marking are parallel lines of different color. Also is described a method for producing an inner tube element by forming a tube member between two differing end parts by winding fiber material which is impregnated with hardenable synthetic resin and hardening the tube member then formed. According to the invention a material in strip form and bearing an appropriate orientation marking is incorporated during the forming of such tube member.

5 Claims, 2 Drawing Sheets

INNER TUBE ELEMENT FOR USE IN A DEVICE FOR TAKING SOIL SAMPLES, AND METHOD FOR MANUFACTURING SUCH AN INNER TUBE ELEMENT

BACKGROUND OF THE INVENTION

The invention relates to an inner tube element for use in a double tube device for taking soil samples during drilling operations, comprising differing end parts for coupling with several identical inner tube elements connected by a tube member made of plastic which is reinforced with fibers.

Such an inner tube element is known from European Patent Specification 0056930, of which applicants are co-owners. When a sample is wanted from a soil layer at great depth, a conventional device is used to drill through the soil layer with a core drill until the desired depth is reached. An inner tube element is pushed over the drilled core, following which the inner tube element is hoisted up and the core material is automatically retained inside the inner tube element. The string of tubes with the desired soil samples is then laid in its entirety next to the derrick and sawn there, into transportable pieces of approximately 1 meter which are closed with end caps. The sawn pieces are subsequently marked, in order to establish their relative positions. Once the tube with the core inside it is sawn it is extremely difficult to determine the vertical orientation of such a piece in the total length of the removed core, in other words, whether a certain end of such a core part is the end lying closest to the ground surface or furthest away from the ground surface. Accurate information concerning the position of such a part in the entire removed core is, of course, of vital importance for the information collected on the basis of the cores, and any doubt on the subject must be ruled out.

Attempts have been made to avoid the above-mentioned disadvantages by marking the pipes at the working site. Such operations are, however, time-consuming and expensive, and mistakes, with all their consequences, are still not ruled out.

SUMMARY OF THE INVENTION

The object of the present invention is then to provide a solution to the above-mentioned problems, and to that end an inner tube element of the type indicated is according to the invention characterized in that the tube member is provided with an orientation marking extending over its entire length and at least covered by a thin layer of plastic.

Providing an orientation marking at least covered by a thin layer of plastic during the formation of an inner tube element ensures that the number of operations at the working site can be restricted to a minimum, while the presence of the orientation marking means that the orientation in the vertical direction of a tube member or tube member part containing a core can be established unequivocally in all cases.

Such markings can, of course, be in many different forms, the simplest being a line running in the axial direction of the tube member and provided with arrow signs. Through the presence of such a marking, a distinction can always be made between the end of an inner tube element or part thereof lying closest to the ground surface and the end furthest away from the ground surface, while the rotation orientation of the core inside the element is also determined very accurately. In particular, the marking is an asymmetrical marking comprising two lines which can be distinguished from each other. One of the lines has, for example, a character A, while the other has a character B; if it is agreed then that in an upright inner tube element or a part thereof the line B must always be on the right-hand side, it is possible in this way always to achieve the correct orientation.

As already indicated, the two ends of an inner tube element are different. One end has an external screw thread and is also known as the male end; the other end has an internal screw thread and is known as the female end.

This embodiment makes the formation of a large range of interconnected inner tube elements very simple.

The asymmetrical marking will always be arranged in the same way relative to the male and female ends, so that even an individual sawn part of an inner tube element with a core inside it is always established as regards its orientation.

The distinction between the different lines can, of course, be applied in many different ways; an attractive way is that the distinction is produced by giving the lines different colors; for example, a red and a blue line can be applied.

If desired, the colored lines can also be of a fluorescent type, so that in poor lighting conditions identification is possible.

The lines advantageously run parallel to each other and spaced apart, in one case the combination of lines running axially, while in another case the lines run in a spiral pattern over the periphery of the tube member; all this depends on the way in which the lines are applied.

Providing an inner tube element according to the invention with an indelible fixed orientation marking ensures that the quality in use is very favorably influenced; as a result of the marking, errors in the assessment of parts of the inner tube element with the drilled-out core in it are avoided.

The invention is also embodied in a method for the production of an inner tube element for use in a double tube device for taking soil samples during drilling operations, in which two end parts which are different from each other are placed on a core and the tube member lying between them is formed by winding of fiber material impregnated with hardenable synthetic resin, following which the synthetic resin is hardened and the inner tube element thus formed is removed from the core, which is characterized in that a material in strip form which can combine with the synthetic resin and with an orientation marking on it is incorporated near the external periphery of the tube member, in such a way that in the finished tube the strip material is at least covered by a thin layer of hardened plastic.

In particular, for the strip material which can combine with the synthetic resin of the tube member use is made of a porous material into which the synthetic resin can penetrate, and with which the synthetic resin can combine during its hardening.

By providing the orientation marking on a porous strip material, for example a non-woven material, and processing such a material during the formation of an inner tube element by winding fiber material impregnated with hardenable plastic, a very simple possibility of applying an orientation marking is achieved.

In a first embodiment of the method the porous or non-porous strip material can be applied by a rubbing operation to the surface of a wound tube member. The rubbing operation means that penetration of the not yet hardened plastic into the porous strip material takes place, as a result of which the strip material is also covered by a thin layer thereof after hardening of the plastic.

It is also possible during the production of an inner tube element for the porous or non-porous strip material with the marking on it to be wound along with the other material under the last winding layer of the material impregnated with synthetic resin, in order in that way to form an orientation marking which is covered by a layer of synthetic resin reinforced with fibers.

In both cases the marking will be extremely easy to see, so that mistakes in the subsequent handling of the inner tube element with the core in it are largely ruled out.

The strip material on which the orientation marking is placed expediently bears one or more additional orientation markings for establishing during the winding the correct orientation of the porous strip material relative to the end parts. With the use of an orientation marking material, for example a strip material with lines on it, it can still happen that when such a strip material is being applied a mistake is made, so that the strip material comes to lie incorrectly relative to the end parts. It must also be pointed out that the end parts are of such a shape and design that they can be connected to the drilling device and each other only in one way, in other words, one of the two end parts will always be closest to the ground surface during the carrying out of the drilling operation, while the other end part will always lie furthest way from the ground surface. By now applying an additional orientation marking to the strip material bearing the orientation marking, it can be ensured that the orientation marking always assumes the correct position relative to the ends of an inner tube element. Thus, for example, the strip material can be provided with a logo containing the company name, in which case during the application of the strip material the person applying it must ensure that from his working position the company name is legible at all times in positive lettering and that the company name is legible in the usual way from left to right during the operation of applying the strip material. In this way the maximum guarantee of the orientation marking being applied in the correct manner is also ensured during the production process.

BRIEF DESCRIPTION OF THE DRAWINGS

The invention will now be explained with reference to the accompanying drawing, in which:

FIG. 3 shows an inner tube element with an asymmetrical orientation marking in another arrangement;

FIG. 1 shows a part of an inner tube element 1 with an orientation marking 2 on it, comprising a throughgoing line with arrow signs superimposed on it. The top and bottom side of an inner tube element part can always be established without doubt by observing the direction of the arrow signs, while the rotation orientation is also clearly ascertained.

FIG. 2 shows an inner tube element 1 with an asymmetrical marking in the form of lines 3 and 4, one line being, for example, blue and another line red. Reference number 5 indicates an additional orientation marking which can be in many different forms, and in this case an expert carrying out the tube formation and standing in front of a tube in the horizontal position during the formation must be able to read the word EPOX in normal writing running from left to right.

FIG. 3, finally, shows an inner tube element part with an asymmetrical marking in the form of lines 6 and 7, which in this case are wound spirally.

The material of an inner tube element will generally be a synthetic resin which can be hardened by means of a hardening agent, such as an epoxy resin which is hardened with an anhydride or amine hardening agent at normal or raised temperature. The fibers for reinforcing the plastic of an inner tube element are advantageously in the form of glassfiber material.

Figure 1:
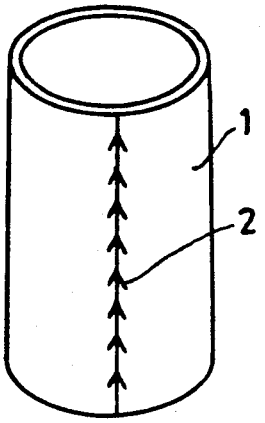
FIG. 1 shows a part of an inner tube element with a very simple orientation marking applied.
Figure 2:
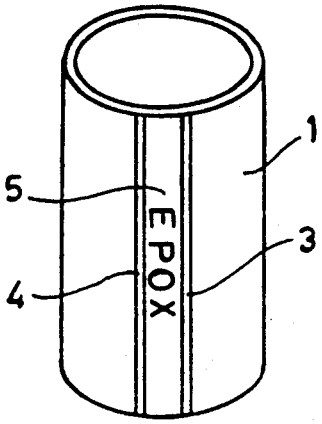
FIG. 2 shows the same inner tube element part with an asymmetrical orientation marking.
Figure 5:
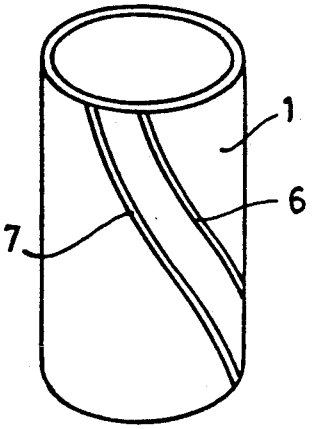
Figure 4:
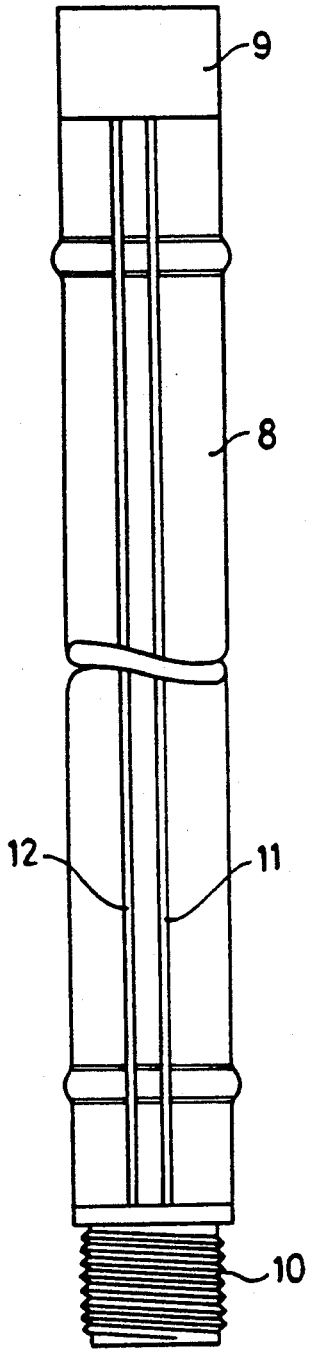
FIG. 4 shows a complete inner tube element with an asymmetrical marking.

FIG. 4 shows a complete inner tube element 8 with a female end 9 and a male end 10.

When an inner tube element 8 is being placed the male part 10 will as a rule be directed downwards and be connected by a screwing movement to the upward directed female part 9 of an earlier positioned inner tube element 8.

The asymmetrical line pattern 11, 12 is always oriented in the same way relative to the ends 9 and 10. The left line 12 will often be blue and the right line 11 red in the arrangement shown here.

What is claimed is:

1. Inner tube element for use in a double tube device for taking soil samples during drilling operations, comprising differing end parts for coupling with several identical inner tube elements connected by a tube member made of plastic which is reinforced with fibers, in which the tube member has an orientation marking extending over its entire length and at least covered by a thin layer of plastic, said marking formed as a part of said tube member.

2. Inner tube element according to claim 1, in which the marking is an asymmetrical marking comprising two lines which can be distinguished from each other.

3. Inner tube element according to claim 2, in which the lines are of different colors.

4. Inner tube element according to claim 2, in which the lines run parallel to each other at a short distance from each other.

5. Inner tube element according to claim 4, in which the lines run in a spiral pattern.

* * * * *